US005320481A

United States Patent [19]

Suzuki

[11] Patent Number: 5,320,481

[45] Date of Patent: Jun. 14, 1994

[54] CARRY PALLET FOR A NUMERICAL CONTROLLED ROUTER

[75] Inventor: Nobuyoshi Suzuki, Shizuoka, Japan

[73] Assignee: Heian Corporation, Shizuoka, Japan

[21] Appl. No.: 22,671

[22] Filed: Mar. 1, 1993

[51] Int. Cl.[5] ..... B65D 19/12

[52] U.S. Cl. ..... 414/799; 108/55.3; 414/923

[58] Field of Search ..... 414/799, 923; 108/55.1, 108/55.3

[56] References Cited

U.S. PATENT DOCUMENTS 4,437,412 3/1984 Trautsch ..... 108/55.3 X

FOREIGN PATENT DOCUMENTS 2314796 9/1974 Fed. Rep. of Germany ..... 108/55.1

2503061 7/1976 Fed. Rep. of Germany ..... 108/55.1

*Primary Examiner*—Richard A. Schacher

*Attorney, Agent, or Firm*—Burgess, Ryan and Wayne

[57] ABSTRACT

A carry pallet is disclosed which has a plurality of supporting members attached to the periphery of a pallet base, sacrifice board carrying portions are mounted on the upper portions of the supporting members and stop plates are arranged on the carrying portions. When process boards and a sacrifice board are arranged on the pallet, the sacrifice board is carried on the carrying portions of the carry pallet without contact with the stack of process boards without shifting and falling.

6 Claims, 5 Drawing Sheets

CARRY PALLET FOR A NUMERICAL CONTROLLED ROUTER

BACKGROUND OF THE INVENTION

The present invention relates to a carry pallet in a numerical control router for carrying a sacrifice board and a process board for processing by a numerical control router.

The applicant presents a process system of the numerical control router (see published Japanese Application No. 2-301385) in which the sacrifice board and the process board are carried by carry pallet from a storehouse and the process board is processed by the numerical control router. In the numerical control router, a traverser is moved in front of the pointed shelf in the storehouse, the pallet having the process board and the sacrifice board is put on the traverser and is carried on a supply conveyer. When the supply conveyer moves the pallet to a predetermined position, a robot positions the sacrifice board and the process board on a table respectively and the numerical control router processes the process board.

In the process, system of a numerical controlled router, when the size of the sacrifice board is same as that of the process board on the pallet, the sacrifice board on the process board is scarcely shifted. But, when the size of the process board is smaller than that of the sacrifice board, the sacrifice board is shifted on the process board or falls from the process board.

SUMMARY OF THE INVENTION

It is, therefore, the primary object of the present invention to provide a carry pallet for a numerical controlled router in which the sacrifice board does not fall from the pallet when the pallet on which the sacrifice board and the process boards are arranged is moved.

In order to accomplish the above and other objects, the present invention comprises a pallet base for carrying one or more process boards, supporting member or members attached to the periphery of the pallet base having a carrying portion or portions for carrying the sacrifice board.

DESCRIPTION OF THE PREFERRED EMBODIMENTS

Figure 1:
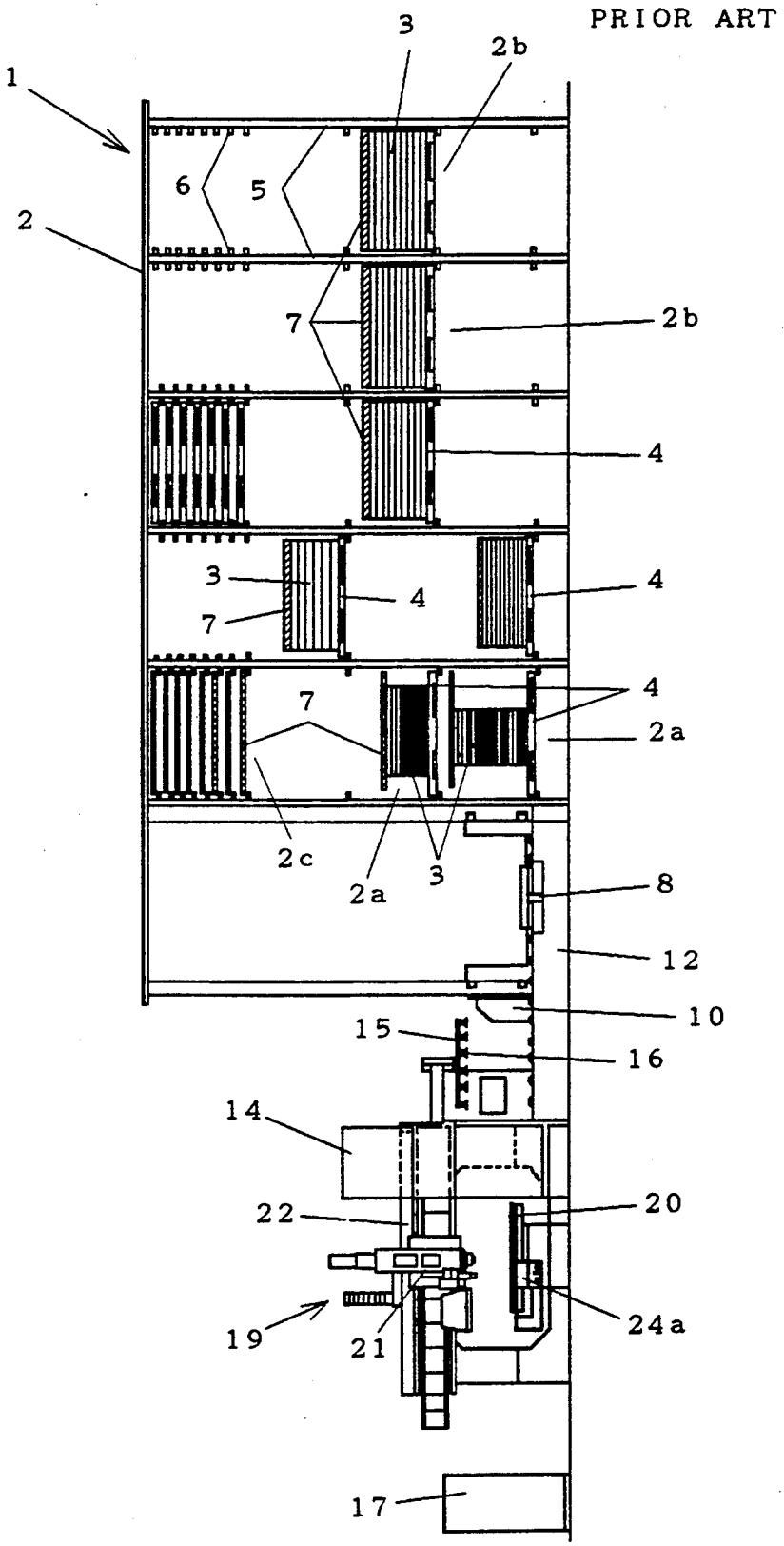
FIG. 1 shows a side view of a process system in a numerical control router presented by the applicant.
Figure 2:
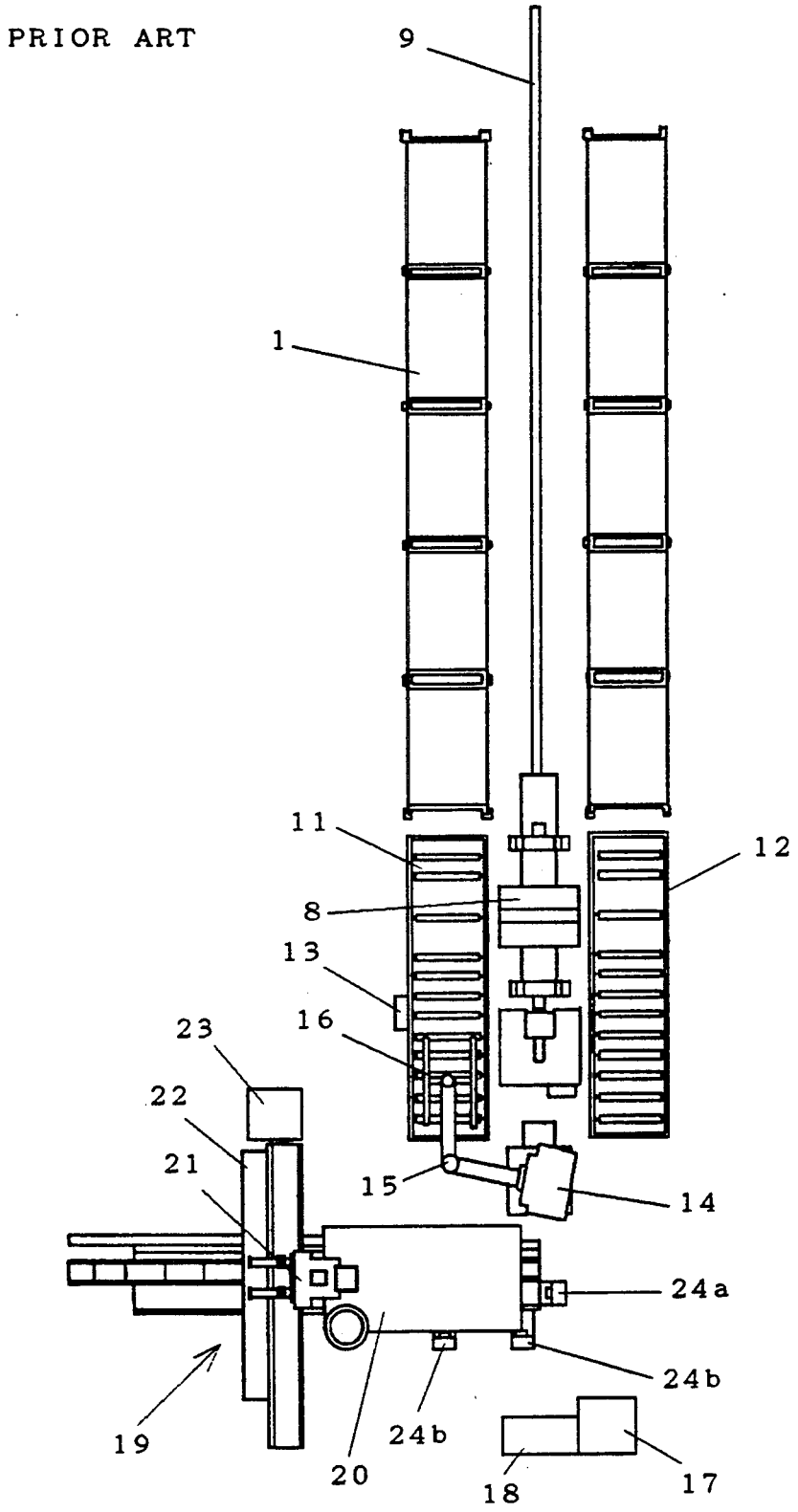
FIG. 2 shows a plane view of a numerical control router in FIG. 1.

Referring to FIGS. 1 and 2, in a process system of a numerically controlled router, a plurality of carry pallets 4 carrying the process boards 3 are put on projections 6 of supporting poles 5 in shelves 2 of the storehouse 1. A rail 9 for moving a traverser 8 between the shelves 2 is arranged and a traverser control unit 10 is arranged at the end of the rail 9. A carry conveyer 11 is arranged at one side of the traverser control unit 10, a discharge conveyer 12 is arranged at the other side of the traverser control unit 10 and a conveyer control unit 13 for controlling the carry conveyer 11 and the discharge conveyer 12 is arranged at the side of the carry conveyer 11.

A robot 14 is arranged near to the traverser control unit 10 and comprises a work arm 15 and a suction port 16 connected to the work arm 15. A robot control unit 17 is arranged apart from the robot 14 and a main control unit 18 is arranged at the side of the robot control unit 17.

A suction table 20 of a numerical controlled router 19 is arranged near the robot 14 and a first control unit 22 and a second control unit 23 are mounted on a rail for moving a head 21 of the numerically controlled router 19. Also, rule stoppers **24*a*, 24*b* and 24*c* are mounted at the side of the suction table 20**.

In such a numerical controlled router system, when the traverser 8 moves a carry pallet 4 on which a designated sacrifice board 7 and process boards 3 are placed onto the carry conveyer 11, the pallet 4 is moved to a predetermined position on the carry conveyer 11, the robot moves and positions the sacrifice board 7 on the suction table 19 and moves and positions the process board 3 on the sacrifice board 7 by the rule stoppers **24*a*, 24*b* and 24*c* respectively, and then the process board 3 is processed by the router head 21**.

However, in the numerical controlled router system, when the sacrifice board 7 is same size as the process board 3 such as a pallet 4 of shelf **2*b*, the sacrifice board 7 is not shifted on the process board 3 when the pallet 4 is moved. But, when the process boards 3 are smaller than the sacrifice board 7 as on pallet 4 on a shelf 2*a*, the sacrifice board 7 is shifted or falls from the upper part of the stack of process boards 3**.

Figure 3:
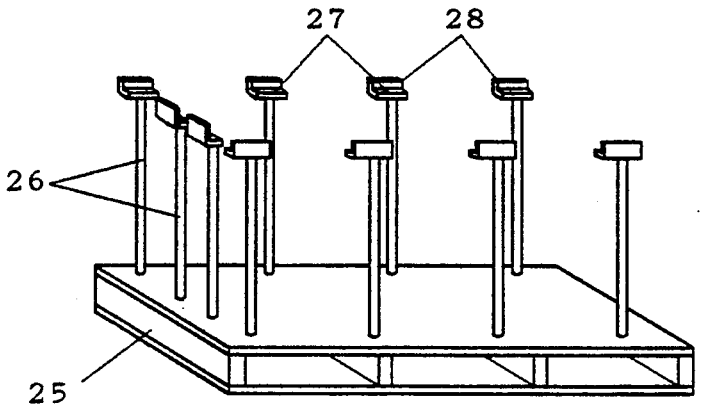
FIG. 3 shows a perspective view of a carrying pallet of an embodiment of the present invention.

Referring to FIG. 3, which illustrates a carry pallet of the invention a plurality of supporting pole members 26 are mounted at the periphery of a carry pallet base 25 and arranged so a not to prevent the insertion of the suction port 16. Sacrifice board carrying portions 27 are respectively attached to the upper parts of the supporting poles 26. If the poles 26 are easy to move, transverse supports (not shown) are attached to the upper portions of the supporting poles 26.

Figure 4:
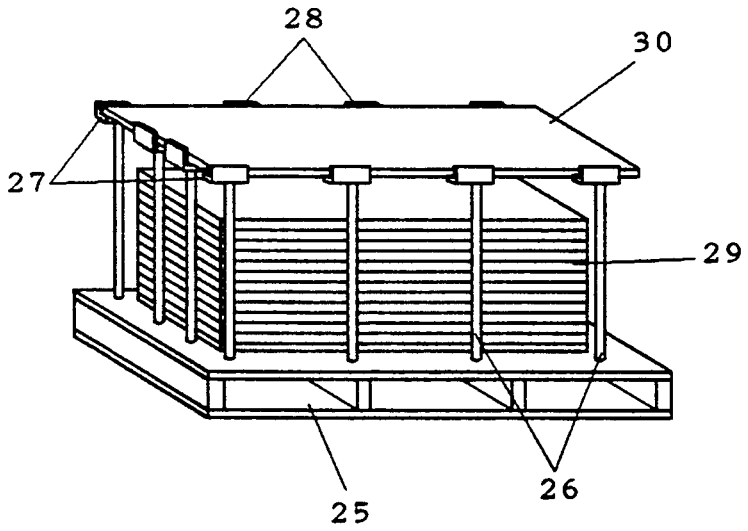
FIG. 4 shows a perspective view of the carrying pallet on which the sacrifice board and the process board in FIG. 3 are arranged.

In the carry pallet of the present embodiment, as shown in FIG. 4, the process boards 29 are stacked on the pallet base 25 and the sacrifice board 30 is placed on the carrying portions 27. Accordingly, the sacrifice board 30 is placed on the carrying portions 27 does not contact the of the process boards 29. Also, because stop plates 28 are respectively attached to the carrying portions 27, shifting and falling of the sacrifice board 30 are prevented by stop plates 28 when the pallet is moved.

Figure 5:
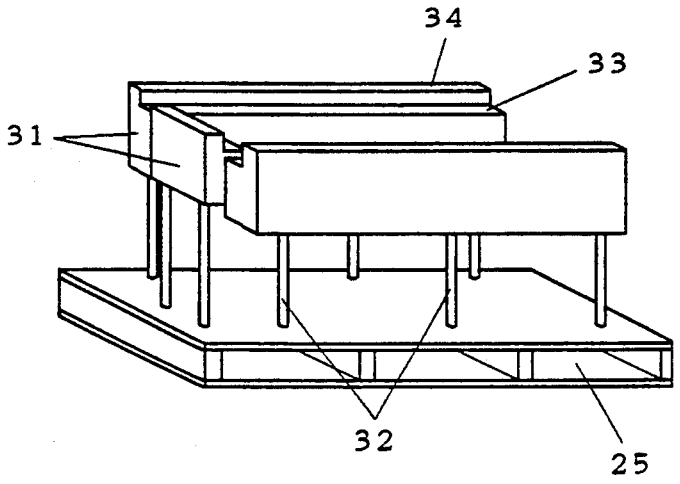
FIG. 5 shows a perspective view of a carrying pallet in an other embodiment of the present invention.

Referring to FIG. 5, sacrifice board supporting plate members 31 are attached to the pallet base 25 by leg members 32 thereof and carrying portions 33 are formed on the upper portions of the supporting plate members 31 to carry the sacrifice board 30 and stop plates 34 are attached to the putting portions 33 to prevent the shift and fall of the sacrifice board 30.

Figure 6:
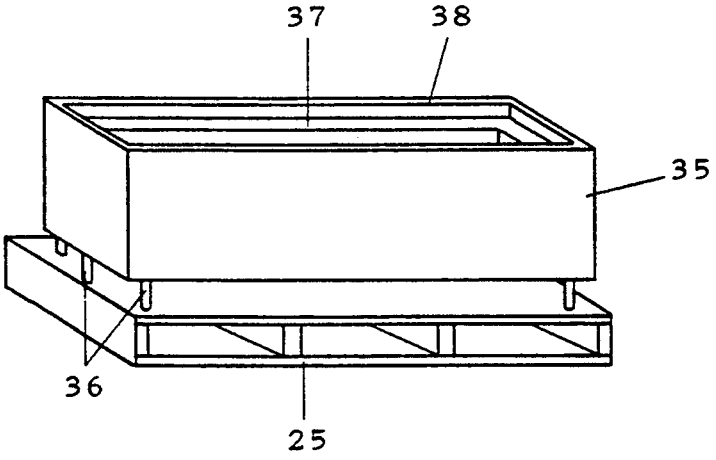
FIG. 6 shows a perspective view of a carrying pallet in the an other embodiment of the present invention.

Referring to FIG. 6, a rectangular supporting frame member 35 is attached to the periphery of the pallet base 25 with leg members 36 thereof, a sacrifice board carrying portion 37 is formed on the upper portion of a rectangular supporting frame member 35 to carry the sacrifice board 30 and a rectangular stopper plate 38 is formed at the periphery of the sacrifice board carrying portion 37.

Figure 7:
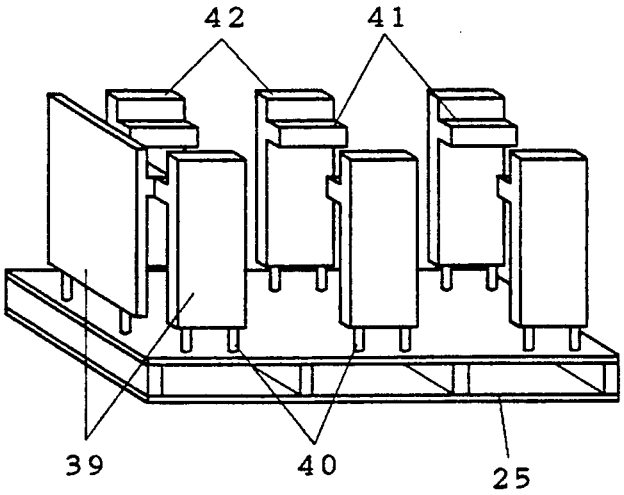
FIG. 7 shows a perspective view of a carrying pallet in a furthermore embodiment of the present invention.

Referring to FIG. 7, a plurality of supporting plate members 39 are attached to the periphery of the pallet base 25 with leg members 40 thereof, sacrifice board carrying portions 41 are formed the upper portions of the plate members 39 and stop plates 42 are formed on the carrying portions 41 to prevent the shift and fall of the sacrifice board 30.

Because the carry pallets are constructed as shown in the above embodiments, the sacrifice boards 30 are respectively carried on the carrying portions 27, 33, 37 and 41 of the supporting members 26, 31, 35 and 39 not in contact with the stack of process boards 29.

Though the supporting plate member 31, the rectangular supporting frame member 35 and the supporting plate members 39 are attached to the pallet base 25 with the leg members 32, 36 and 40, the members 31, 35 and 39 can be directly attached to the pallet base 25 and another attaching member may be used for attaching the members 31, 35 and 39 to the carry pallet.

Though the stop plates 28, 34, 38 and 42 are formed on the carrying portions 27, 33, 37 and 41 of the supporting members 26, 31, 35 and 39 to prevent the shift and fall of the sacrifice board 30, friction members or rough members may be arranged on the carrying portions 27, 33, 37 and 41 of the supporting members 26, 31, 35 and 39 to prevent the shifting and falling of the sacrifice board 30. Also, magnets may be attached to the carrying portions of the pallet base 25 and the corresponding portions of the sacrifice board.

As stated above, in the carry pallet of the present invention, because the process boards are carried on the pallet base and the sacrifice board is carried on the carrying portions of the carry pallet, the sacrifice board is not in contact with the stack of the process boards and shifting and falling of the sacrifice board is prevented.

What is claimed is:

1. A carry pallet comprising:

a base;

support means mounted on said base for defining a first area on said base for supporting at least one process board; and sacrifice board carrying means, mounted at upper ends of the support means, the sacrifice board carrying means defining and at least partially enclosing a supporting area greater than the first area for supporting at least one sacrifice board.

2. A carry pallet of claim 1, wherein members for preventing the shifting or falling of the sacrifice board are arranged on the sacrifice board carrying means.

3. A carry pallet of claim 2, wherein the members for preventing the shifting or falling of the sacrifice board comprise stop plates.

4. A carry pallet of claim 1, wherein the support means comprise poles.

5. A carry pallet of claim 1, wherein the support means comprise plate members.

6. A carry pallet of claim 1, wherein the support means comprise a rectangular frame.

* * * * *